US005685529A

United States Patent [19]

McFarland

[11] Patent Number: 5,685,529

[45] Date of Patent: Nov. 11, 1997

[54] DUAL ACTION PRINTED SETS TRANSPORT

[75] Inventor: Freddie McFarland, Rochester, N.Y.

[73] Assignee: Xerox Corporation, Stamford, Conn.

[21] Appl. No.: 629,114

[22] Filed: Apr. 8, 1996

[51] Int. Cl.[6] ..... B65H 29/46; B65H 39/02

[52] U.S. Cl. ..... 270/30.05; 270/58.11

[58] Field of Search ..... 270/30.05, 30.66, 270/58.08, 58.09, 58.11

[56] References Cited

U.S. PATENT DOCUMENTS

| | | | |
|---|---|---|---|
| 4,522,383 | 6/1985 | Macey | 270/58.08 |
| 4,782,363 | 11/1988 | Britt | 355/14 SH |
| 4,903,952 | 2/1990 | Russel et al. | 270/58.09 |
| 4,926,220 | 5/1990 | Matysek et al. | 355/313 |
| 5,018,656 | 5/1991 | Phelps | 227/84 |
| 5,018,717 | 5/1991 | Sadwick et al. | 271/207 |
| 5,022,637 | 6/1991 | Coons, Jr. | 270/58.08 |
| 5,396,321 | 3/1995 | McFarland et al. | 355/313 |

*Primary Examiner*—Hoang Nguyen

[57] ABSTRACT

In a reproduction apparatus with a set collator, finisher, stacker, and a set transport system for transporting printed sets therebetween, with first and second double jawed clamping systems for concurrently moving two sets of sheets at a time, a single pneumatic drive system operated by a single valve operates all four jaws of both set clamping systems. A variable displacement pneumatic piston system thereof allows the first and second clamping systems to clamp sets of different thicknesses.

4 Claims, 3 Drawing Sheets

DUAL ACTION PRINTED SETS TRANSPORT

Disclosed in the embodiments herein is an improved dual action set transport system for the output of sets of printed sheets of a reproduction apparatus, in which a single drive actuator operates dual set clamping and transporting systems.

The embodiment herein discloses an improvement in dual and/or simultaneous sheets set transport systems such as that particularly illustrated in FIG. 3 of Xerox Corporation U.S. Pat. No. 5,018,656 issued May 28, 1991 to Russell L. Phelps, and/or Xerox Corporation U.S. Pat. Nos. 4,926,220; 4,782,363; 5,396,321; and 5,018,717. However, the present invention is not limited thereto.

These dual set handling patents illustrate systems in which substantially simultaneous finishing and stacking can be provided in an output system for the output of printed sheets from a printer or copier. As shown, one set clamp can pull one collated print job set or book at a time out of the set compiler and put that set into the finisher, which finisher may provide stitching, stapling, and/or tape edge binding or other such finishing. Meanwhile, concurrently or simultaneously, the other, separate, set clamp grasps the previous set in the finisher and moves that set into the stacker or stacking area on top of previously stacked output sets. Advantages of this prior known dual clamping system include moving the two sets simultaneously for greater overall productivity or processing speed. Also, the two set movement distances may be sequential, with one set is moving between the compiler and the finisher over the first distance while the other set is being further moved on from the finisher to the stacker to cover the remainder of the total distance between the compiler and the output stacker. However, the cited previous system is complex and utilizes four separate air cylinders, two each for operating the two set clamps, with a separate cylinder for respectively driving the upper and lower jaws of each clamp. This prior mechanism also requires critical set up dimensions, due to the geometry of the clamp mechanism, to avoid misclamping of the sets or set disturbances. Furthermore, such a four cylinder system requires four air lines into the carriage assembly (which must be flexible for movement of the system), and three solenoid valves to operate the clamp mechanism, and exhaust valves to exhaust waste air from the upper air cylinders due to the remote location of the solenoid valves.

In the disclosed embodiments, a single driving or actuating system operates both of the set clamps. As shown, this may utilize a single pneumatic cylinder system and a set of linkages in place of the above-described separate actuating systems, and may be controlled by a single air valve. The system disclosed herein greatly reduces the mass of the moving carriage assembly and the clamps, reduces the cost of the system, and eliminates critical set ups. Furthermore, angular motion of the upper clamps is reduced with the present system. Such angular motion is undesirable since that can cause set disturbance. The disclosed system reduces set disturbance during clamping and unclamping by providing a clamping force essentially perpendicular to the set. The disclosed system also compatably accommodates both small and very large sets being clamped. The reduced mass and improved set handling can provide increased productivity.

A specific feature of the specific embodiments disclosed herein is to provide, in a reproduction apparatus for generating printed sheets with an operatively associated collator for collating the printed sheets into sets of sheets, a finisher for binding the sets of printed sheets, and a stacker for stacking the bound sets of printed sheets, with a set transport system for transporting the sets of printed sheets between said collator, said finisher and said stacker, said set transport system including a first jawed clamping system for clamping a set of printed sheets in said collator for movement of the set to said finisher, and a second jawed clamping system for concurrently moving another set of printed sheets from said finisher to said stacker; the improvement comprising a single drive actuator system operatively connected to both said first and second jawed clamping systems to actuate both said first and second jawed clamping systems with said single drive actuator system.

Further specific features disclosed herein, individually or in combination, include those wherein said single drive actuator system comprises a pneumatic cylinder and piston drive; and/or wherein said single drive actuator comprises a variable displacement pneumatic piston system which allows said first and second jawed clamping systems to clamp respective sets of printed sheets of different set thicknesses; and/or wherein said single drive actuator comprises a single pneumatic piston system controlled by a single valve to actuate both said first and second jawed clamping systems to clamp respective sets of printed sheets therein; and/or wherein both said first and second jawed clamping systems have upper and lower clamping jaws and the set engagement end of said upper jaw is constrained to vertical movement and is actuated subsequent to the actuation of said lower clamping jaw to provide improved set clamping integrity; and/or wherein said single drive actuator comprises a variable displacement pneumatic piston system which allows said first and second jawed clamping systems to clamp respective sets of printed sheets of different set thicknesses.

In reproduction apparatus such as xerographic or other copiers and printers or multifunction machines, it is increasingly important to provide faster yet more reliable and more automatic handling of the physical image bearing sheets. It is desirable to reliably feed and accurately register copy sheets of a variety and/or mixture of sizes, types, weights, materials, humidity and other conditions, and susceptibility to damage.

The disclosed system may be operated and controlled by appropriate operation of conventional control systems. It is well known and preferable to program and execute printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs. The resultant controller signals may conventionally actuate various conventional electrical solenoid or cam-controlled sheet deflector fingers, motors or clutches, valves, or other components.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figures (approximately to scale) wherein:

Figure 1:
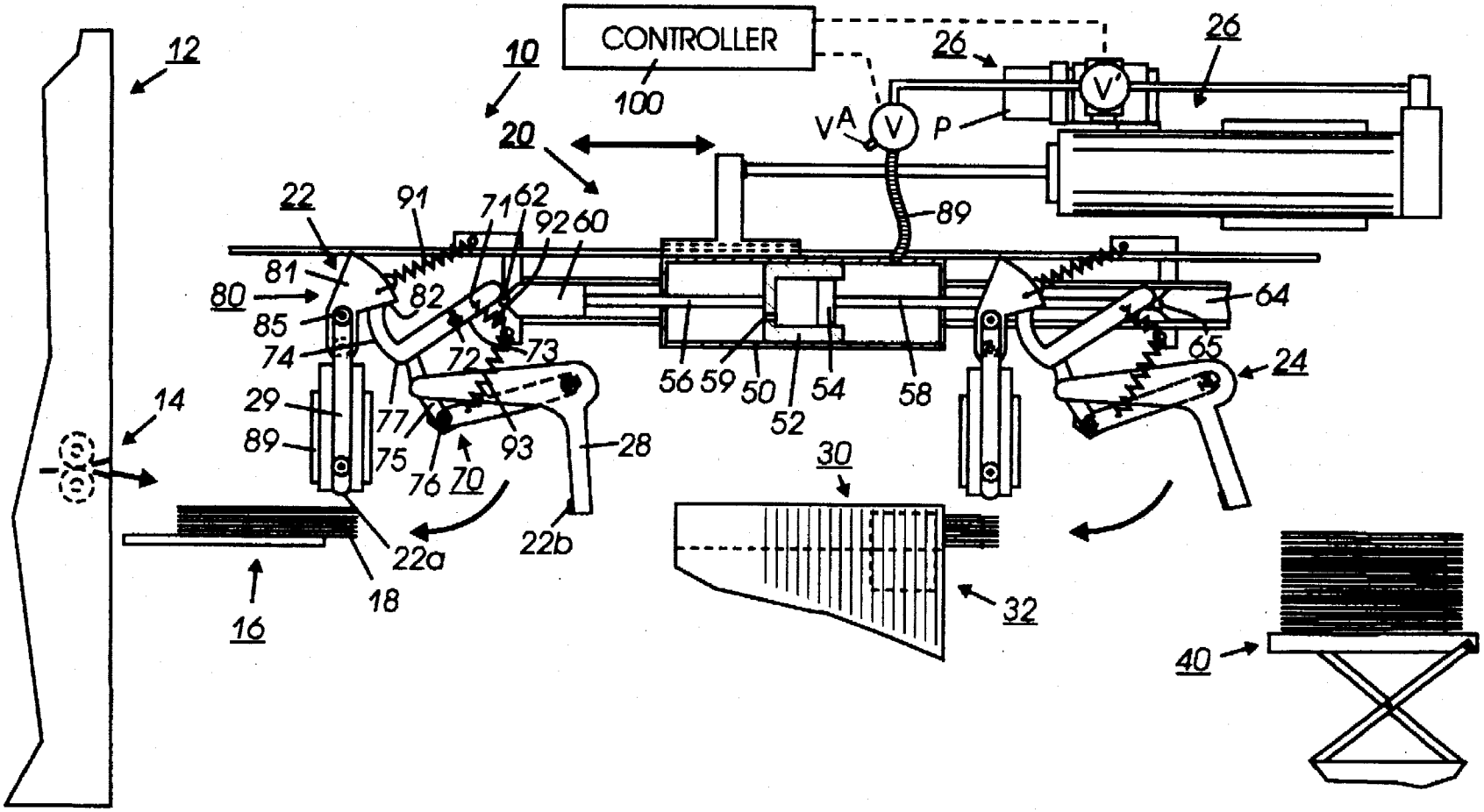
FIG. 1 is a frontal schematic view of an exemplary printed sheets output handling system, including one example of the subject dual sets transporting system in its unactuated, rest, or return position.

Referring to the figures, there is illustrated one example of a printed sheets output handling system 10, in which a printer 12 (any high speed, high production, printer or copier) produces an output of printed sheets at printer output 14 which are conventionally collated and stacked one set at a time in a suitable known collator 16. The collator 16 may be one tray of an array of bindexer bins, as described in above-cited patents such as U.S. Pat. No. 4,782,363. This stack of sheets 18, i.e., the individual print job set to be finished and/or stacked at the output, is moved on from the collator 16 by a sets transport system 20 which will be described in further detail herein. The sets transport system 20 here includes a first set clamping system 22 and a separate, spaced, second set clamping system 24, which may be essentially similar to the first clamping system 22, as will be further described. The entire sets transport system 20, with both clamping systems, is laterally translated, after the sets have been clamped, by a carriage movement system 26, as will be further described. In that movement, the set being transported by the first clamping system 22 is held clamped between an upper set clamping surface **22*a* on an upper clamp jaw 29 and a lower set clamping surface 22*b* on a lower jaw 28 (note especially FIG. 3). This first set clamping system 22 of the sets transport system 20 moves the print job set 18 from the collator 16 to a finishing station 30 upon movement of the transport system 20 by its movement system 26**.

Simultaneously with this clamping and then movement of the sets transport system 20, the second set clamping system 24 has clamped the prior stack of sheets 18 in the finisher 30 and then moves that set onto a sets stacker 40. That second set 18 is stacked on top of preceding sets in the stacker 40. It may be either finished or unfinished, depending on what was done to it in the finisher 30. Here, an exemplary stapler 32 is schematically shown in the finisher 30. As is well known, set finishing may comprise one or more staples or stitches and/or tape or other edge binding or the like, or optionally the set 18 can be left unbound. As is known, additional clamps or hold-down means may be provided in the finisher for holding a set during finishing. Both the finisher 30 and sets stacker 40 here may be of known types such as those shown on the above-cited patents and commonly used with the well-known Xerox Corporation "5090" and "DocuTech"™ copiers and printers producing on-line collated print job sets.

As schematically illustrated in FIG. 1, the reciprocal horizontal movement by the movement system 26 of the entire set transport system 20, including both of its connecting first and second clamping systems 22 and 24, may be by a conventional pneumatic piston connected to a conventional supply of air pressure P through a valve V' to either a double acting pneumatic piston of a conventional type, or, as shown, a single acting piston with a spring return to the initial or starting position of FIG. 1. The total horizontal movement of the entire set transport system 20 may be as little as the dimension of a larger sheet, even though the distance between the collator 16 and the output set stacker 40 may be approximately twice that, because of the sequential movement of a set from the collator 16 to the finisher 30 at the same time and in the same movement as the movement of the preceding set from the finisher 30 to the set stacker 40, downstream therefrom. That is, each print job set 18 is moved downstream from the collator to the output in two successive movements by the two different clamping systems, with the finisher 30 being utilized as the intermediate or rest position therebetween, whether or not the set is being finished. (As noted, this is a feature of the existing above-identified Xerox Corporation products and patents.)

Turning now to the sets transport system 20, and the subject exemplary improvements therein, here both the first and second set clamping systems 22 and 24 are driven or operated entirely from a single pneumatic cylinder 50. That is in contrast to the above identified products and patents in which four separate pneumatic cylinders and separate valves therefor were required for the four jaw clamp actuations. With the present system, only a single and much simpler pneumatic system is required, controlled by a single dual position pneumatic valve V, from the air supply P. All four clamp jaws are operated therefrom, yet the clamping action is actually improved for reduced likelihood of skewing of sheets within the clamped set, and there is automatic compensation to allow the respective sets being clamped by the first (22) and second (24) clamping systems to have vastly different set thicknesses (numbers of sheets per set, and/or paper weights).

Describing this exemplary improved sets transporting system 20 clamps actuations system in greater detail, the solenoid or other actuation by controller 100 of the pneumatic valve V connects air pressure supply P via flex line 89 into the right hand interior of cylinder 50. That moves to the left, both a push piston 52 and a pull piston 54. Piston 54 is, as shown, additionally movable inside of a cylinder in the piston 52 by a short distance, corresponding to the potential difference between two clamped set 18 set thicknesses, e.g. variances from 2 to 50 sheets. A piston air bleed hole 59 is provided through the push piston 52 into the internal cylinder therein holding the pull piston 54, so that the pull piston 54 may move relative to (and further to the left than) push piston 52 when the air pressure P is being applied and resistance to clamping is encountered by the one clamping system clamping a set thicker than the set being clamped by the other clamping system.

The push piston 52 is directly connected by pushrod 56 to an external push cam block 60 with a cam surface 62 thereon for sequentially actuating the first set clamping system 22, as will be described. Correspondingly, the pull piston 54 is externally connected by pullrod 58 to a pull cam block 64 with a pulling pin or cam surface 65 thereon for actuation of the second set clamping system 24. As shown, the cam blocks 60 and 64 may be mounted in tracks or guides to maintain their horizontal movement and prevent lateral forces on their piston rods 56, 58.

Since in the example herein the first set clamping system 22 and its operation are essentially identical to the second set clamping system 24 except that the actuation thereof is push versus pull as described above, only the first clamping system 22 need be described herein. Although the illustrated cams and levers system may initially look somewhat complicated, the operation thereof is relatively straightforward. Also, it will be appreciated that other cam and/or lever and/or linkage systems could be utilized to perform the movements and functions described herein.

Figure 2:
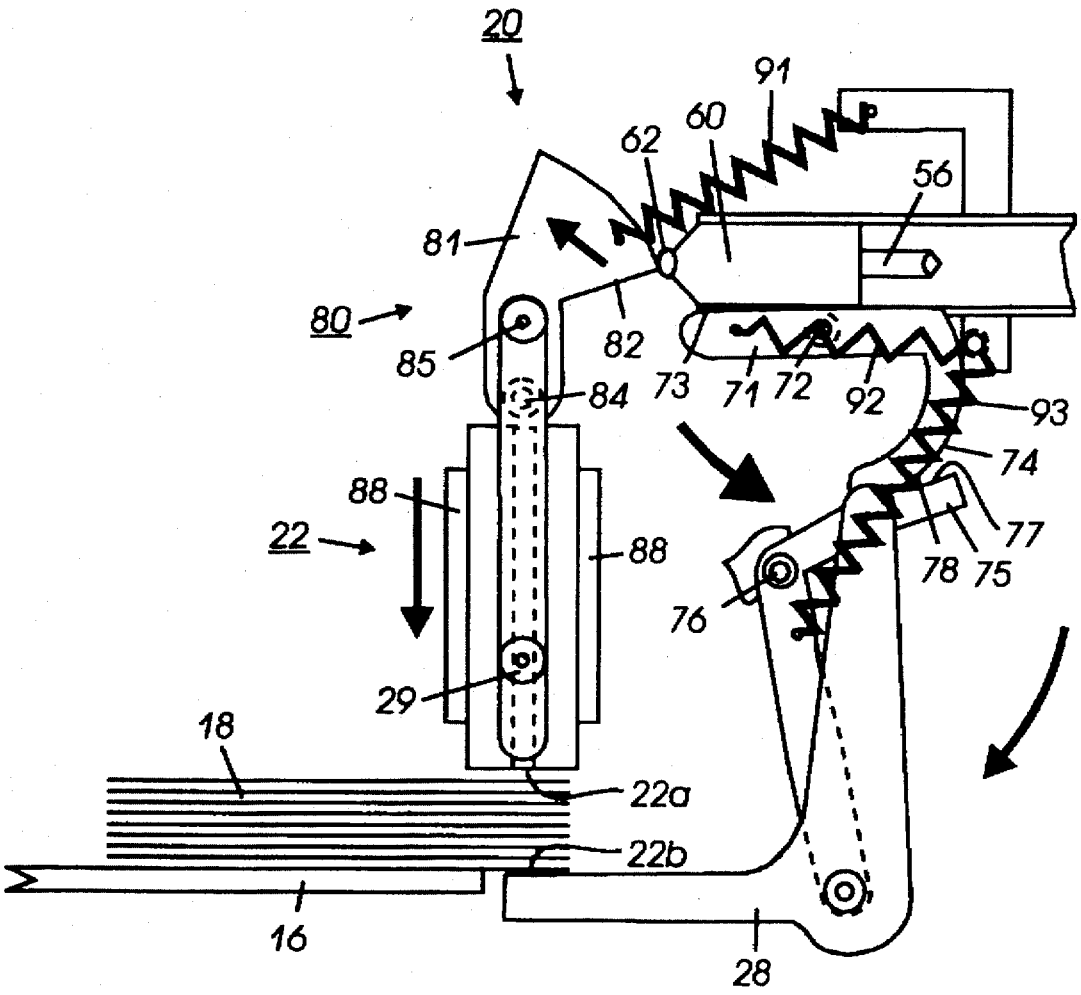
FIG. 2 is an enlarged frontal view of one of the two similar illustrated set clamping systems of FIG. 1, shown in a partially activated position.
Figure 3:
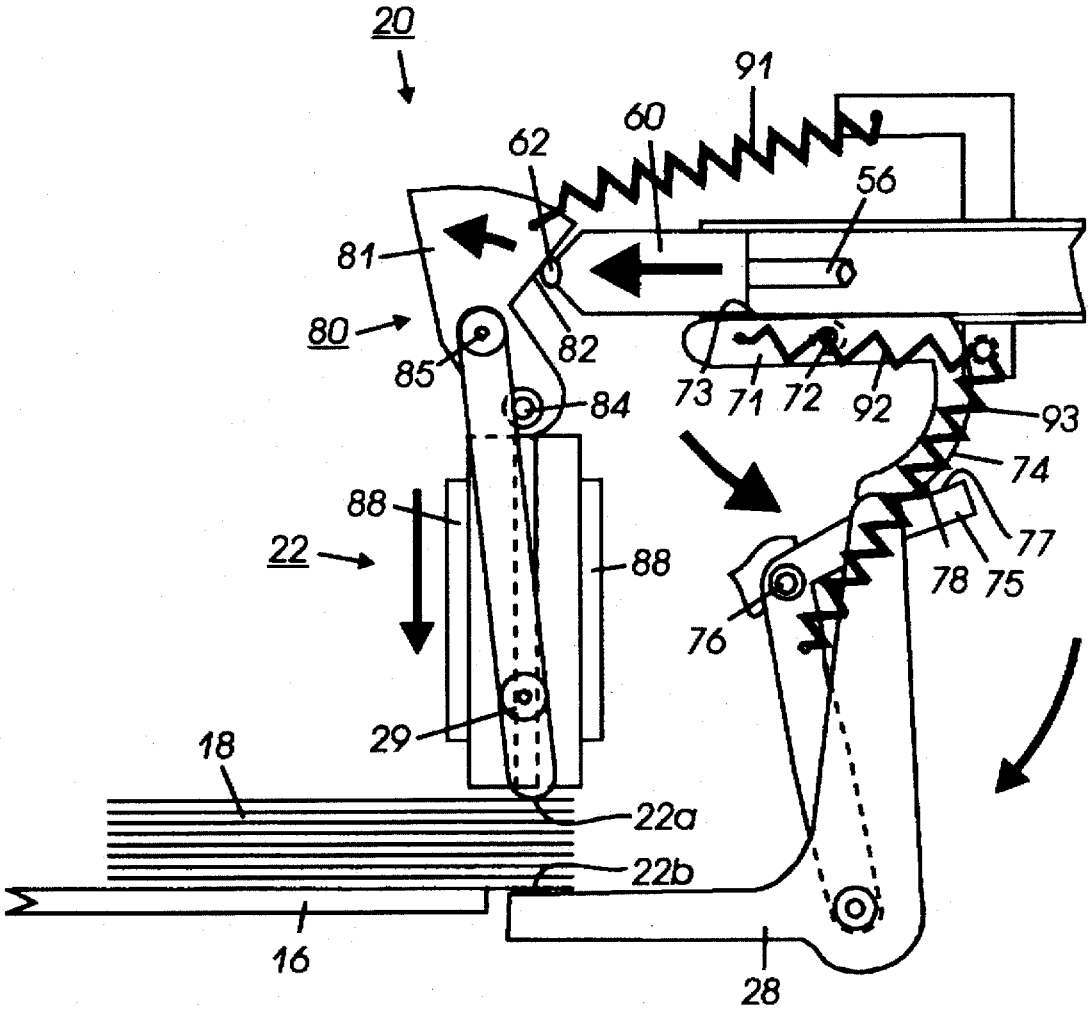
FIG. 3 is the set clamping system of FIG. 2 shown in a fully actuated set clamping position.

As the push piston 52 pushes the push cam block 60 to the left, the cam surface 62 thereof first actuates and operates a lower clamp jaw 28 activating system 70 (as in FIG. 2), and then further movement of cam 62 (as in FIG. 3) actuates an upper clamp jaw 29 activating system 80. The lower clamp activating system 70 is actuated by engagement of a first lever 71 at its first camming surface 73 to pivot the first lever 71 about its pivot 72. The first lever 71 in turn engages at its first camming surface 77 a second lever 75 to pivot about its pivot 76. That pivots the lower clamping jaw 28 from its initial retracted or substantially vertical position (as shown in FIG. 1) upwardly towards its substantially horizontal clamping position as illustrated in FIGS. 2 and 3. Once this initial rotation into position of the lower clamping jaw 28 has been accomplished, as in FIG. 2, the further rotational movement of the first lever 71 by the further movement of the push cam block 60 by its piston 52 causes the engagement of a constant radius camming surface 74 against a second cam surface 78 of the second lever 75 to hold the lower clamping jaw 28 stationarily up in its horizontal or set clamping position thereafter.

The further movement of the push cam block 60 thus merely holds the clamp lower jaw 28 in position, while the cam block 60 further moves on to now engage the upper clamp activating system 80. That is accomplished (as shown in FIG. 3) by the cam surface 62 now engaging a camming surface 82 of a cam arm 81 of the upper clamp activating system 80 to pivot that cam arm 81 about its pivot 84. Cam arm 81 connects as shown through another pivot 85 to the clamp upper jaw 29. The camming surface 82 is above the pivot 84 and the pivot 85 is below the pivot 84. Here, the operative end **22*a* of the clamp upper jaw 29 is constrained to vertical reciprocal movement by being mounted in a slide block 88. This desirably prevents the surface 22*a* of the upper clamp jaw 29 from making any lateral movement relative to the set 18 while it is clamping, thereby reducing potential dishelvelment or skewing of the top sheets of the set being clamped as compared to some prior clamping systems. (The slide block 88** may be at one side of the compiler.)

The downward vertical movement of the lower end of the clamp upper jaw 29 confined within the slide block 88 thus moves the upper set clamping surface **22*a* at the end thereof down onto the top of the stack of sheets 18 being clamped in the collator 16. Meanwhile, the lower set clamping surface 22*b* on the lower jaw 28 has already been opposedly positioned under the bottom sheet of that same set 18 (and may even raise it slightly). The continued air pressure inside the pneumatic cylinder 50 on the push piston 52 continues to apply pressure therefrom to maintain the clamping force between the lower and upper jaws 28 and 29 of the clamping system 22 as long as air pressure P is applied thereto. The set in the collator 16 is thus now fully clamped and ready for its movement to the finisher 30 by the movement of the entire sets transport system 20 by its pneumatic movement system 26. Continued clamping pressure is provided during this movement by the use of a conventional pneumatic flex line 89 connecting between the valve V and pneumatic cylinder 50**.

Upon the solenoid or other actuation of the valve V to its other position, the pressure source P is disconnected from the pneumatic cylinder 50 and the pressure side of the pneumatic cylinder 50 is connected through that same valve V to an atmospheric vent $V^A$. Thus, pressure is fully removed from the pneumatic cylinder 50. The return springs 91, 92, 93 or the like respectively connecting to the above-described levers as shown then can automatically return the entire system 20 with its clamping system 22 to its initial or normal position as in FIG. 1, and reopen both of the jaws of the clamps and thus release the set 18. That is, valve V is a normally closed valve, which in its second position vents at $V^A$ to atmosphere to allow the systems return springs to return all the clamps and pistons from their FIG. 3 positions to their initial positions as shown in FIG. 1. This is automatically done after the set has been transported into the proper position in the finisher 30. Simultaneously or concurrently therewith, the previous set in the finisher 30 will have been placed on the equidistant proper stacking position on the set stacker 40 and released by the concurrent and substantially identical operation of the second set clamping system 24.

While the embodiment disclosed herein is preferred, it will be appreciated from this teaching that various alternatives, modifications, variations or improvements therein may be made by those skilled in the art, which are intended to be encompassed by the following claims.

The invention claimed is:

1. In a reproduction apparatus for generating printed sheets with an operatively associated collator for collating the printed sheets into sets of sheets, a finisher for binding the sets of printed sheets and a stacker for stacking the bound sets of printed sheets, with a set transport system for transporting the sets of printed sheets between said collator, said finisher and said stacker, said set transport system including a first jawed clamping system for clamping a set of printed sheets in said collator, for movement of the set to said finisher, and a second jawed clamping system for concurrently moving another set of printed sheets from said finisher to said stacker; the improvement comprising a single drive actuator operatively connected to both said first and second jawed clamping systems to actuate both said first and second jawed clamping systems with said single drive actuator;

wherein said single drive actuator comprises a single pneumatic piston system controlled by a single valve to actuate both said first and second jawed clamping systems to clamp respective sets of printed sheets therein.

2. The reproduction apparatus of claim 1 wherein said single drive actuator comprises a variable displacement pneumatic piston system which allows said first and second jawed clamping systems to clamp respective sets of printed sheets of different set thicknesses.

3. In a reproduction apparatus for generating printed sheets with an operatively associated collator for collating the printed sheets into sets of sheets, a finisher for binding the sets of printed sheets and a stacker for stacking the bound sets of printed sheets, with a set transport system for transporting the sets of printed sheets between said collator, said finisher and said stacker, said set transport system including a first jawed clamping system for clamping a set of printed sheets in said collator, for movement of the set to said finisher, and a second jawed clamping system for concurrently moving another set of printed sheets from said finisher to said stacker; the improvement comprising a single drive actuator operatively connected to both said first and second jawed clamping systems to actuate both said first and second jawed clamping systems with said single drive actuator;

wherein both said first and second jawed clamping systems have upper and lower clamping jaws and the set engagement end of said upper jaw is constrained to vertical movement and is actuated subsequent to the actuation of said lower clamping jaw to provide improved set clamping integrity.

4. The reproduction apparatus of claim 3 wherein said single drive actuator comprises a variable displacement pneumatic piston system which allows said first and second jawed clamping systems to clamp respective sets of printed sheets of different set thicknesses, and wherein said single drive actuator comprises a single pneumatic piston system controlled by a single valve to actuate both said first and second jawed clamping systems to clamp respective sets of printed sheets therein.

* * * * *